US006353143B1

(12) United States Patent
Fang et al.

(10) Patent No.: US 6,353,143 B1
(45) Date of Patent: Mar. 5, 2002

(54) FUEL COMPOSITION FOR GASOLINE POWERED VEHICLE AND METHOD

(75) Inventors: Jiafu Fang, Spring; Dewey P. Szemenyei, The Woodlands, both of TX (US); Troy H. Scriven, Waterford, NY (US)

(73) Assignee: Pennzoil-Quaker State Company, Houston, TX (US)

( * ) Notice: Subject to any disclaimer, the term of this patent is extended or adjusted under 35 U.S.C. 154(b) by 0 days.

(21) Appl. No.: 09/428,802

(22) Filed: Oct. 28, 1999

Related U.S. Application Data

(60) Provisional application No. 60/108,200, filed on Nov. 13, 1998.

(51) Int. Cl.[7] ..... C01L 1/04
(52) U.S. Cl. ..... 585/1; 585/14
(58) Field of Search ..... 44/300; 585/1, 585/14; 208/16

(56) References Cited

U.S. PATENT DOCUMENTS

| | | | | |
|---|---|---|---|---|
| 1,204,638 | A | | 11/1916 | Axtell |
| 1,331,054 | A | | 2/1920 | Dinsmore |
| 1,361,153 | A | | 12/1920 | Hayes |
| 1,495,501 | A | | 5/1924 | Taber et al. |
| 1,507,619 | A | | 9/1924 | Oleson |
| 1,534,573 | A | | 4/1925 | de la Riboisiere |
| 1,587,899 | A | | 6/1926 | Carroll et al. |
| 1,907,309 | A | | 2/1933 | Van Schaack, Jr. |
| 1,990,499 | A | | 2/1935 | Odell |
| 1,991,333 | A | | 2/1935 | Pevere |
| 2,066,234 | A | | 12/1936 | Sloane et al. |
| 2,088,000 | A | | 1/1937 | Savage |
| 2,099,850 | A | | 11/1937 | Howard |
| 2,106,661 | A | | 1/1938 | Savage |
| 2,106,662 | A | | 1/1938 | Savage |
| 2,125,875 | A | | 9/1938 | Barnard |
| 2,176,747 | A | | 10/1939 | Schneider et al. |
| 2,220,345 | A | | 11/1940 | Moore et al. |
| 2,321,280 | A | | 6/1943 | Brown |
| 2,332,298 | A | | 10/1943 | Clarke et al. |
| 2,337,492 | A | | 12/1943 | Pevere et al. |
| 2,340,412 | A | | 2/1944 | Clarke et al. |
| 2,360,585 | A | | 10/1944 | Ross et al. |
| 2,361,054 | A | | 10/1944 | Pevers |
| 2,468,507 | A | | 4/1949 | Moore et al. |
| 2,626,893 | A | | 1/1953 | Morrow |
| 3,697,240 | A | | 10/1972 | Hori et al. |
| 4,357,146 | A | | 11/1982 | Heeren |
| 4,748,289 | A | | 5/1988 | Douglas |
| 5,059,741 | A | | 10/1991 | Foley |
| 5,208,402 | A | * | 5/1993 | Wilson ..... 585/1 |
| 5,679,116 | A | | 10/1997 | Cunningham et al. |
| 5,681,358 | A | | 10/1997 | Spencer et al. |
| 5,853,433 | A | * | 12/1998 | Spencer ..... 44/300 |
| 5,938,799 | A | | 8/1999 | Spencer et al. |

FOREIGN PATENT DOCUMENTS

| | | | |
|---|---|---|---|
| EP | 530745 | A1 | 3/1993 |
| EP | 596611 | A1 | 5/1994 |
| EP | 667387 | A2 | 8/1995 |
| GB | 906533 | | 9/1962 |
| WO | WO91/18850 | | 12/1991 |
| WO | WO 98/03613 | | 1/1998 |
| WO | WO98/47986 | | 10/1998 |

OTHER PUBLICATIONS

Zakharova, Khimiyai Teck Topliv: Masel, N.2 35–38 (1994)
Additives for improving octane, 1994.*
International Search Report, Jan. 18, 2001.
Partial Search Report, Jan. 2001.
Letter re: Nationwide Industries' Rescue Emergency Fuel, Nov. 23, 1983.
Advertisement for "RESCUE®", Nationwide Industries, Inc., 3684 Meadow Ln., Bensalem, PA, 19020, Date Unknown.

* cited by examiner

*Primary Examiner*—Margaret Medley
*Assistant Examiner*—Cephia D. Toomer
(74) *Attorney, Agent, or Firm*—Jenkins & Gilchrist A Professional Corporation

(57) ABSTRACT

A fuel composition with a high flash point and a high octane number is provided. The preferred embodiment of the fuel comprises a paraffin or aromatic hydrocarbon component which may be mixed with an additive of alcohols, ethers, esters, organometallic compounds or mixtures thereof. The fuel composition is useful as emergency fuel for use in gasoline powered vehicles.

36 Claims, No Drawings

FUEL COMPOSITION FOR GASOLINE POWERED VEHICLE AND METHOD

CROSS REFERENCE TO RELATED APPLICATIONS

The application claims priority to U.S. Provisional Application Ser. No. 60/108,200, entitled "Emergency Fuel for Gasoline Powered Vehicle and Method," filed on Nov. 13, 1998, now abandoned.

FIELD OF THE INVENTION

The invention relates to a fuel composition useful for powering the internal combustion engine of a vehicle.

BACKGROUND OF THE INVENTION

It is often desirable for a vehicle driver to have a safe, high-quality fuel composition inside the vehicle in case the driver runs out of gas. Preferably, fuel composition should have a relatively high flash point, relatively high octane number, and relatively high heat value. Moreover, it should enable the engine to start easily at least when the engine is warm or hot. Formulations disclosed in the prior art for fuel composition are relatively low in octane number, causing the engine to knock and potentially leading to engine damage. Therefore, there is a need for a fuel composition which is safe and has a relatively high octane number.

SUMMARY OF THE INVENTION

A fuel composition suitable for gasoline-powered vehicles has been developed that has a relatively high flash point and exhibits good driveability characteristics. The fuel composition comprises a base fuel with a flash point greater than about 100° F. Optionally, the fuel composition may include one or more additives. The base fuel may be an aromatic hydrocarbon, an aliphatic hydrocarbon, or mixtures thereof. Preferred base fuels include isoparaffins, branched paraffins, aromatic hydrocarbons, and mixtures thereof. The base fuel may be present in the fuel composition in the amount of about 50% to about 100% by weight. Additives may be present in the fuel composition as the balance. The additives includes, but are not limited to, alcohols, ethers, esters, organometallic compounds, and mixtures thereof. Advantages and properties of the fuel composition become apparent with the following description of embodiments of the invention.

DESCRIPTION OF EMBODIMENTS OF THE INVENTION

Embodiments of the invention provide a fuel composition with a relatively high octane number which includes a hydrocarbon or a hydrocarbon mixture as the base fuel. The hydrocarbon may be aromatic, aliphatic, or mixtures thereof. In some embodiments, the fuel composition has a positive fuel sensitivity. In other embodiments, the fuel composition has a negative fuel sensitivity. The fuel compositions can be used to power the internal combustion engine of a vehicle as an alternative to regular gasoline.

Fuel sensitivity is defined as the difference between the Research Fuel Number ("RON") and the Motor Octane Number ("MON") of a fuel composition. RON and MON can be measured by techniques, such as ASTM D2699 and ASTM D-2700, respectively. Octane number generally is a measure of driveability of a fuel for gasoline-powered engines. Another indicator is "octane rating" which is defined herein as the sum of MON and RON divided by two.

Preferably, the octane rating of the fuel compositions is greater than about 70; more preferably, the octane rating of the fuel compositions is greater than about 81.

The fuel composition in accordance with embodiments of the invention generally has a flash point greater than about 100° F. Preferably, the fuel composition has a flash point higher than about 130° F.; more preferably, higher than about 140° F. This increased flash point provides a substantial safety margin to the consumer over regular gasoline, enabling the consumer to store the fuel composition inside the vehicle without the potential hazards presented by regular gasolinle. U.S. Department of Transportation regulations classify materials with a flash point greater than 100° F. as combustible as opposed to flammable, as with regular gasoline.

As described above, the fuel composition in accordance with embodiments of the invention includes branched hydrocarbon, aromatic hydrocarbon, or mixtures thereof as the base fuel. The base fuel may be used alone or in combination with one or more additives. Preferably, the fuel composition comprises paraffins with a branched or iso molecular structure. Paraffins are hydrocarbon compounds which can be straight-chained, branched, or cyclic. Cycloparaffins are referred to as naphthenes. Straight chain paraffins also are called normal paraffins. An isoparaffin is a branched paraffin whose structure is similar to isobutane (except that the number of carbon atoms is higher). It is noted that "branched paraffin" and "isoparaffin" sometimes are used interchangeably in the art to refer to alkanes with a branched structure. In some embodiments, the fuel composition is a mixture of a branched hydrocarbon and an aromatic composition which is substantially free of any naphthenic compounds. Preferably, a mixture of isoparaffin and aromatic hydrocarbon which is substantially free of any naphthenic compounds is used as emergency fuel, with or without additives.

When an aromatic composition is mixed with a branched hydrocarbon, the aromatic composition may be present in the range of about 0. 5% to about 99.5% by weight, and the branched hydrocarbon may be present in the range of about 0.5% to about 99.5% by weight. Preferably, the aromatic composition may be present in the range of about 10% to about 50% by weight, and the branched hydrocarbon may be present in the range of about 50% to about 90% by weight. More preferably, the aromatic composition may be present in the range of about 30% to about 40% by weight, and the branched hydrocarbon may be present in the range of about 60% to about 70% by weight.

In some embodiments, high-purity isoparaffin mixtures are used as the base fuel or a component thereof. These high-purity isoparaffin mixtures contain close to about 99.9% isoparaffinic hydrocarbons, with less than about 0.1 % of aromatics and olefins. Impurities, such as acids, chlorides, nitrogen, peroxides, and sulfur, are typically less than a few parts per million respectively. These isoparaffin mixtures include hydrocarbon molecules whose molecular structure may be highly branched, iso, or both. The number of carbon atoms per molecule may be in the range of about 4 to about 20, preferably in the range of about 9 to about 13. These mixtures have a boiling range between 150° and 500° F., preferably between 200° and 450° F., and most preferably between about 240° and about 420° F. The average molecular weight of these mixtures is in the range of about 100 to 300.

Various grades of isoparaffin mixtures are available. They may be identified by the range of the number of carbon atoms per molecule, the average molecular weight, and the boiling point range.

Several grades of isoparaffin mixtures were used in embodiments of the invention. They are designated as Isoparaffin A, Isoparaffin B, Isoparaffin C, and Isoparaffin D (the A, B, C and C designations are merely for the convenience of reference). Table 1 lists some physical properties of these isoparaffin mixtures. It should be noted that the numerical value may vary within an acceptable range. For example, the molecular weight for a particular paraffin may vary within a range of 10; the boiling point within a range of 15 ° C.; and the carbon number per molecule within a range of 5.

TABLE 1

TYPICAL PHYSICAL PROPERTIES OF VARIOUS GRADES OF ISOPARAFFIN

| Property | Isoparaffin A | Isoparaffin B | Isoparaffin C | Isoparaffin D |
|---|---|---|---|---|
| Flash Point TCC, ° C. | 40 | 53 | 53 | 61 |
| Distillation Temperature Range, ° C. | | | | |
| Approximate Initial Boiling Point | 157 | 176 | 177 | 188 |
| 10% | 159 | 177 | 180 | 191 |
| 50% | 163 | 181 | 183 | 194 |
| 90% | 170 | 184 | 190 | 201 |
| 95% | 173 | 185 | 194 | 204 |
| Approximate Dry Point | 176 | 191 | 197 | 206 |
| Vapor Pressure psia@ 100° F. | 0.27 | 0.12 | 0.11 | 0.1 |
| Approximate Average Molecular Weight | 149 | 160 | 164 | 171 |
| Number of Carbon Atoms | $C_9$–$C_{12}$ | $C_9$–$C_{12}$ | $C_9$–$C_{12}$ | $C_{10}$–$C_{13}$ |

A commercial product sold under the trade name Isopar® G available from Exxon Chemical can be used as Isoparaffin A. Similarly, Isopar® H, Isopar® K, and Isopar® L of Exxon can be used as Isoparaffin B, Isoparaffin C, and Isoparaffin D, respectively. In addition, Isopar® C, Isopar® E, Isopar® M and Isopar® V available from Exxon (which are different from Isopar® G, Isopar® H, Isopar® K, and Isopar® L) may be used. Other commercial products, such as Soltrol® 130 available from Philips Petroleum Company also can be used. It should be noted that the above branched isoparaffins can be used alone or in combination with another composition.

In addition to isoparaffin mixtures, aromatic hydrocarbons also may be used as the base fuel or a component thereof. The aromatic hydrocarbon may make up the entire formulation without the addition of additives, although aromatic hydrocarbons also may be mixed with one or more isoparaffins. Moreover, suitable additives, such as an octane booster, may be added to the aromatic hydrocarbon. It should be understood that any aromatic solvent with the appropriate properties may be used to practice the invention.

Suitable aromatic compositions include, but are not limited to, aromatic hydrocarbons such as substituted and unsubstituted benzene and polynuclear aromatic compounds, such as naphthalene, anthracene and phenanthracene, and mixtures thereof It is noted that substitution on the aromatic ring can be single or multiple substitution. Suitable substituents include, but are not limited to, methyl, ethyl, propyl, butyl, hydroxyl, phenyl, carboxylate, and so on. In some embodiments, the aromatic compounds may be represented by the following formula:

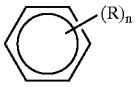

wherein n can be vary from 0 to 6 to denote unsubstituted and substituted aromatic compounds, and R can be any organic radical. Preferably, R is an alkyl group with 1 to 20 carbon atoms. More preferably, the alkyl group should have 1 to 10 carbon atoms. The alkyl group can be a straight chain, branched chain, or a phenyl group with or without substitution.

Examples of aromatic compounds which may be used in embodiments of the invention include, but are not limited to, benzene, toluene, o,m,p-xylene, pseudocumene, ethylbenzene, n-propylbenzene, cumene, n-butylbenzene, isobutylbenzene, sec-butylbenzene, tert-butylbenzene, biphenyl, diphenylmethane, triphenyl methane, 1,2-diphenylethane and similarly alkyl-substituted naphthalenes and anthracenes. Additional aromatic compounds also include phenol, catechol, acylphenol (such as acetylphenol), carbonate esters (such as phenyl methyl or ethyl carbonate and diphenyl carbonate), alkylphenol (such as anisole), chloro and bromo-benzene, aniline, acyl aniline (such as acetanilide), methyl and ethylbenzoate, thiophenol and acylated thiophenol, nitrobenzene, diphenylether, diphenylsulfide and similarly substituted naphthalenes and anthracenes, in particular naphthols (such as mono and dihydroxy naphthalene). The above aromatic compounds may be used alone or in a mixture with other aromatic compounds.

An example of a suitable aromatic hydrocarbon is a product sold under the trade name AROMATIC™ 150 Fluid from Exxon Chemical. AROMATIC™ 150 Fluid is composed of mainly aromatic compounds, i.e., at least about 98.0% by volume. It has a flash point of at least about 63° C. The boiling point range is between about 179° C. and about 213° C. AROMATIC™ 150 typically is composed of a narrow-cut aromatic solvent containing about 23 wt. % tetra-methyl benzenes, about 22 wt. % ethyl dimethyl benzenes, about 15 wt. % mono-, di- and tri-methyl indanes, about 8 wt. % diethyl benzenes, about 8 wt. % naphthalene, about 5 wt. % trimethyl benzenes, about 2 wt. % indane, and about 1 wt. % or less of methyl ethyl benzenes, propyl benzenes, methyl propyl benzenes, butyl benzenes, hexyl benzenes, indene, methyl naphthalenes, and xylenes.

Another example of an aromatic hydrocarbon is a product sold under the trade name AROMMATIC™ 100 Fluid from Exxon Chemical. AROMATIC™ 100 Fluid is composed of mainly aromatic compounds, i.e., at least about 98.0% by volume. The boiling point range is between about 154 ° C. and about 174 ° C. AROMATIC™ 100 solvent typically is composed of a narrow-cut aromatic solvent containing about 40 wt. % trimethyl benzenes, about 35 wt. % methyl ethyl benzenes, about 1 wt. % propyl and isopropyl benzenes, about 3 wt.% ethyl dimethyl benzenes, about 2 wt. % methyl (n- and iso-) propyl benzenes, about 2 wt. % diethyl benzenes, less than about 1 wt. % each of mono butyl benzenes and tetramethyl benzenes, about 6 wt. % xylenes, and minor amounts of ethyl benzene and $C_{10}$–$C_{11}$, saturates.

As a substitute for an aromatic composition, cyclopentanes, cyclopentadienes, cyclopentenes, and mixtures thereof may be used as a component of the base fuel. U.S. Pat. Nos. 4,72,823; 4,849,566; 4,929,782; 5,012,022; 5,012,023, and 5,144,095 disclose a class of such cyclopentanes, cyclopentadienes, and cyclopentenes which may be used in embodiments of the invention. All of the above patents are incorporated by reference in their entirety herein.

The octane number of the fuel composition can be enhanced by adding additives such as octane boosters, and the fuel sensitivity can be adjusted favorably in this manner. Suitable additives that can be used as an octane booster include, but are not limited to, alcohols, ethers, esters, and organometallic compounds. Other known octane boosters also may be used. These additives can be used alone or together with others. Octane boosting and other additives may be present in the range of a few ppm to about 50% by weight. U.S. Pat. No. 5,853,433 discloses numerous examples of suitable additives, and the disclosure of this patent is incorporated by reference in its entirety herein. Some non-limiting examples of octane boosters are ethyl acetate, isoamyl acetate, amyl acetate, isoamyl propionate, isoamyl nonanoate, isobutyl acetate, isobutyl alcohol, methyl butyrate, methyl caproate, methyl caprylate, etc.

An organometallic compound refers to a metal-containing compound whose molecules include carbon-metal linkage. Suitable organometallic compounds include any such compounds which are capable of increasing the octane rating of a fuel. For example, organo-manganese compounds and organo-iron compounds are especially suitable. Other metals may include, but are not limited to, metals of Groups IB, IIB, IIIB, IVB, VB, VIB, VIIB, and VIIIB of the Periodic Table of the Elements.

In some embodiments, ferrocene and butyl ferrocene are used as octane boosters. In other embodiments, methylcyclopentadienyl manganese tricarbonyl ("MMT") is used as an octane booster. It should be understood that any organometallic compound that has a similar structure to ferrocene or MMT may be used as an octane booster. For example, metallocene compounds are such organometallic compounds. U.S. Pat. Nos. 5,001,244, 5,272,236, and 5,278,272 disclose numerous organometallic compounds for use as a catalyst for olefin polymerization. These organometallic compounds also may be suitable for use as octane in embodiments of the invention. The disclosures of these patents are incorporated by reference in their entirety herein.

Non-limiting examples of some suitable organometallic compounds are: $(\eta^5\text{-}C_5H_5)_2Fe$, $(\eta^5\text{-}C_5H_5)_2Cr$, $(\eta^5\text{-}C_5H_5)_2Ni$, $(\eta^5\text{-}C_5H_5)_2Co^+$, $(\eta^5\text{-}C_5H_5)_2TiCl_2$, $(\eta^5\text{-}C_5H_5)_2WH_2$, dibenzenechromium, dibenzenevanadium, $(C_6H_5)_2Mn$, and derivatives thereof. The derivatives can be obtained by single or multiple substitution by one or more hydrocarbyl groups on the rings. Moreover, the rings can be bridged by a functional group, such as alkylene, amide, amine, carboxylate, etc. It is noted that, when an organometallic compound is used as an octane booster, the base fuel may optionally include naphthenic compounds, i.e., cycloparaffins.

Additives which do not function as octane boosters also may be used in the fuel composition. For example, a fragrance may be added to improve the smell of the fuel composition. Any known fragrances which are at least partially soluble in the fuel can be used. Examples of some suitable fragrances include, but are not limited to, peppermint oil, orange oil, rosemary oil, methyl cinnamate, methyl caprate, isoamy tiglate, turpentine oil, and jasmine oil.

EXAMPLES

The following examples are given to illustrate embodiments of the invention and should not be construed to limit the invention as otherwise described herein. All numerical values are approximate values. With respect to each fuel composition, the preferred weight percentage and the preferred range are given for each ingredient. However, formulations outside the preferred ranges also are acceptable.

In the following examples, the term "Aromatic Solvent" refers to an aromatic composition which has a composition similar to AROMATIC™ 150 available from Exxon Chemical.

First, the RON and MON of various compositions were measured in accordance with ASTM D2699 and ASTM D-2700 respectively. Additives, such as butyl ferrocene, isoamyl acetate (designated as "IIA") and methylcyclopentadienyl manganese tricarbonyl (designated as "AFD-7017") were used in some compositions. The results are presented in Table 2 as follows.

TABLE 2

RON AND MON OF VARIOUS COMPOSITIONS

| COMPOSITION | | | | |
|---|---|---|---|---|
| Base Fuel | Additive (mg/L) | RON | MON | Octane Rating |
| Isopar ® G | None | 77.9 | 84.0 | 81.0 |
| Isopar ® H | None | 77.6 | 83.9 | 80.8 |
| Isopar ® K | None | 76.1 | 82.7 | 79.4 |
| Isopar ® L | None | 68.0 | 77.3 | 72.7 |
| Isopar ® H | AFD-7017 (95.0 mg/L) | 87.0 | 89.1 | 88.1 |
| Isopar ® H | AFD-7017 (146.3 mg/L) | 89.4 | 90.0 | 89.7 |
| Isopar ® L | AFD-7017 (98.2 mg/L) | 79.6 | 84.6 | 82.1 |
| Isopar ® L | AFD-7017 (201.1 mg/L) | 84.5 | 87.5 | 86.0 |
| Isopar ® L | IAA (10.0%) | 72.0 | 78.6 | 75.3 |
| Isopar ® L | AFD-7017 (201.1 mg/L) IAA (10.0%) | 87.4 | 88.5 | 88.0 |
| Soltrol ® 130 | None | 62.2 | 72.5 | 67.4 |
| Isopar ® L | Butyl Ferrocene (201.3 mg/L) | 80.0 | 85.0 | 82.5 |
| Mineral Spirits | None | <40 | <40 | <40 |
| Mineral Spirits | AFD-7017 (201.2 mg/L) | 45.6 | 51.7 | 48.7 |
| | Regular Gasoline | 93.0 | 82.3 | 87.7 |

As shown above, all of the above compositions had a negative fuel sensitivity except mineral spirits and regular gasoline. Moreover, the octane ratings of all of the compositions except mineral spirits were higher than 60. Table 2 also indicates that mineral spirits mixed with an organometallic compound may be used as a fuel. The term "mineral spirits" refers to various types of hydrocarbon solvents, primarily petroleum distillates, which have flash points above about 100° F. and distillation ranges between about 300° F. and 415° F. See *ASTM Standard Specifications* D 235-83, 71–73 (1983). Mineral spirits also is known in the art as white spirits or petroleum spirits.

In addition to the above measurements, various fuel compositions were tested on passenger cars and utility vehicles. They also were tested on various engines of a dynamometer. The various fuel compositions are given in the following examples. The fuels allowed a warm or hot engine to start easily, and the fuel economy was similar to that of commercial regular or premium unleaded gasoline. The flash point ("FP") of the formulas in Examples 1–8 exceeded 140° F., which was measured in accordance with ASTM D-56. Both RON and MON are provided for Examples 1–8.

Example 1

| Ingredient | Wt % | Range, Wt % | MON | RON |
|---|---|---|---|---|
| Butyl ferrocene | 0.1 | 0.0001~5 | 85.0 | 80 |
| Isoparaffin D | 99.95 | 95~100 | | |

Example 2

| Ingredient | Wt % | Range, Wt % | MON | RON |
|---|---|---|---|---|
| (MMT) | 0.05 | 0.0005~5 | 85.0 | 80 |
| Isoparaffin D | 99.95 | 95~100 | | |

Example 3

| Ingredient | Wt % | Range, Wt % | MON | RON |
|---|---|---|---|---|
| MMT | 0.10 | 0.0005~5 | 88.0 | 85 |
| Isoparaffin D | 99.90 | 95~100 | | |

Example 4

| Ingredient | Wt % | Range, Wt % | MON | RON | FP ° F. |
|---|---|---|---|---|---|
| Ferrocene | 0.11 | 0.0005~5 | 84.3 | 81.4 | 142 |
| Isoparaffin D | 99.89 | 95~100 | | | |

Example 5

| Ingredient | Wt % | Range, Wt % | MON | RON | FP ° F. |
|---|---|---|---|---|---|
| Ferrocene | 0.11 | 0.0005~5 | 86.1 | 81.7 | 142 |
| MMT | 43 ppm | 0.0005~5 | | | |
| Isoparaffin D | 99.89 | 95~100 | | | |

Example 6

| Ingredient | Wt % | Range, Wt % | MON | RON | FP ° F. |
|---|---|---|---|---|---|
| Aromatic solvent | 40% | 0~70 | 86.1 | 94.9 | >142 |
| Isoparaffin D | 60% | 30~100 | | | |

Example 7

| Ingredient | Wt % | Range, Wt % | MON | RON | FP ° F. |
|---|---|---|---|---|---|
| Aromatic solvent | 30% | 0.5~95.5 | 85 | 90.2 | >144 |
| Isoparaffin D | 70% | 0.5~95.5 | | | |

The following Example 8 includes the octane rating as defined herein, which is a more precise octane measurement. This number is similar to the octane ratings used at standard gas pumps.

Example 8

| Ingredient | Wt % | Range, Wt % | (R + M)/2 | FP ° F. |
|---|---|---|---|---|
| Ferrocene | 0.084 | 0.0005~5 | 88.6 | >142 |
| Aromatic solvent | 20.000 | 0~70 | | |
| Isoparaffin D | 79.916 | 25–100 | | |

The formulation in Example 9 below has a flash point of greater than 140° F and will be suitable as a fuel composition.

Example 9

| Ingredient | Wt % | Range, Wt % | MON |
|---|---|---|---|
| Butyl ferrocene | 0.05 | 0.0005~5 | 88.0 |
| MMT | 0.05 | 0.0005~5 | |
| Isoparaffin D | 99.9 | 90~100 | |

The formulas presented in Examples 10–18 have flash points of greater than 100° F. and a relatively high octane number. The formulas will allow a warm or hot engine to start easily, and the fuel economy is similar to that of commercial regular or premium unleaded gasoline.

Example 10

| Ingredient | Wt % | Range, Wt % | MON |
|---|---|---|---|
| Isoamyl acetate | 10 | 0~50 | 86.0 |
| Isoparaffin A | 90 | 0~100 | |

Example 11

| Ingredient | Wt % | Range, Wt % | MON |
|---|---|---|---|
| Butyl ferrocene | 0.1 | 0.001~5 | 92.0 |
| Isoparaffin A | 99.9 | 95~100 | |

Example 12

| Ingredient | Wt % | Range, Wt % | MON |
|---|---|---|---|
| Butyl ferrocene | 0.05 | 0.0001~5 | 89.0 |
| Isoparaffin B | 99.95 | 95~100 | |

Example 13

| Ingredient | Wt % | Range, Wt % | MON |
|---|---|---|---|
| MMT | 0.05 | 0.0001~5 | 90.0 |
| Isoparaffin A | 99.95 | 95~100 | |

Example 14

| Ingredient | Wt % | Range, Wt % | MON |
|---|---|---|---|
| MMT | 0.05 | 0.0005~5 | 90.0 |
| Isoparaffin B | 99.95 | 95~100 | |

Example 15

| Ingredient | Wt % | Range, Wt % | MON |
|---|---|---|---|
| Dimethoxane | 10.0 | 1~70 | 87.0 |
| Isoparaffin B | 90.0 | 30~100 | |

Example 16

| Ingredient | Wt % | Range, Wt % | MON |
|---|---|---|---|
| Isoparaffin A | 50.0 | 0~100 | 84.0 |
| Isoparaffin B | 50.0 | 0~100 | |

Example 17

| Ingredient | Wt % | Range, Wt % | MON |
|---|---|---|---|
| Butyl ferrocene | .05 | 0.0005~5 | 91.0 |
| MMT | .05 | 0.0005~5 | |
| Isoparaffin A | 49.0 | 0~100 | |
| Isoparaffin B | 50.9 | 0~100 | |

Example 18

| Ingredient | Wt % | Range, Wt % | MON |
|---|---|---|---|
| Isoamyl acetate | 10.000 | 0.0005~5 | 92.0 |
| MMT | 0.075 | 0.0005~5 | |
| Isoparaffin B | 89.925 | 90~100 | |

The following Examples 19–22 had flash points greater than 100° F. and a relatively high octane number. They were tested on passenger car, utility vehicles, and various engines on a dynamometer. The formulas are suitable for emergency fuel, and engine start-up was easy for both warm or hot engines. The fuel economy was similar to that of commercial or premium unleaded gasoline.

Example 19

| Ingredient | Wt % | Range, Wt % | MON | FP ° F. |
|---|---|---|---|---|
| Ferrocene | 0.11 | 0.0005~5 | 90.1 | 127 |
| Isoparaffin B | 99.89 | 95~100 | | |

Example 20

| Ingredient | Wt % | Range, Wt % | MON | FP ° F. |
|---|---|---|---|---|
| Ferrocene | 0.11 | 0.0005~5 | 90.1 | 127 |
| Isoparaffin C | 99.89 | 95~100 | | |

Example 21

| Ingredient | Wt % | Range, Wt % | MON | FP ° F. |
|---|---|---|---|---|
| Ferrocene | 0.11 | 0.0005~5 | 85.3 | >127 |
| Isoparaffin B | 20.0 | 95~100 | | |
| Isoparaffin D | 79.89 | 95~100 | | |

Example 22

| Ingredient | Wt % | Range, Wt % | MON | FP ° F. |
|---|---|---|---|---|
| Ferrocene | 0.11 | 0.0005~5 | 87.5 | >127 |
| Isoparaffin C | 49.89 | 95~100 | | |
| Isoparaffin D | 50.00 | 95~100 | | |

As demonstrated above, the fuel composition in accordance with embodiments of the invention provides a good alternative to a regular gasoline. The fuel composition is capable of powering a vehicle for an extended period of time. The gas mileage of the fuel composition is comparable to a regular gasoline. Therefore, a useful fuel composition is provided. The fuel composition can be used to power an internal combustion engine in a manner similar to the emergency fuel disclosed in U.S. Pat. No. 5,853,433 (which has been incorporated by reference in its entirety herein).

While the invention has been described with respect to a limited number of embodiments, variations and modifications exist. Numerous variations or modifications may be made without departing from the scope of the invention. The appended claims intend to cover all such variations and modifications as falling within the scope of the invention.

What is claimed is:

1. A fuel composition, comprising:

a mixture ofa branched hydrocarbon and an aromatic composition, the aromatic composition having a boiling range from about 170° C. (354° F.) to about 213° C. (415° F.), wherein the fuel composition has a flash point of 120° F. or higher, and is substantially free of any naphthenic compounds and is capable of powering an internal combustion engine.

2. The fuel composition of claim 1, wherein the branched hydrocarbon is isoparaffin.

3. The fuel composition of claim 1, wherein the aromatic composition includes one or more alkylated benzene compounds.

4. The fuel composition of claim 1, wherein the aromatic composition is a mixture comprising about 23 wt. % tetramethyl benzenes, about 22 wt. % ethyl dimethyl benzenes, about 15 wt. % mono-, di- and tri-methyl indanes, about 8 wt. % diethyl benzenes, about 8 wt. % naphthalene, about 5 wt. % trimethyl benzenes, about 2 wt. % indane, and about 1 wt. % or less of methyl ethyl benzenes, propyl benzenes, methyl propyl benzenes, butyl benzenes, hexyl benzenes, indene, methyl naphthalenes, and xylenes.

5. The fuel composition of claim 2, wherein the isoparaffin is a mixture of $C_9$–$C_{12}$ isoparaffinic hydrocarbons with an average molecular weight of about 149, and the mixture has an initial boiling point of about 157° C. and a dry point of about 176° C.

6. The fuel composition of claim 2, wherein the isoparaffin is a mixture of $C_9$–$C_{12}$ isoparaffinic hydrocarbons with an average molecular weight of about 160, and the mixture has an initial boiling point of about 176° C. and a dry point of about 191° C.

7. The fuel composition of claim 2, wherein the isoparaffin is a mixture Of $C_9$–$C_{12}$ isoparaffinc hydrocarbons with an average molecular weight of about 164, and the mixture has an initial boiling point of about 177° C. and a dry point of about 197° C.

8. The fuel composition of claim 2, wherein the isoparaffin is a mixture of $C_{10}$–$C_{13}$ isoparaffinic hydrocarbons with an average molecular weight of about 171, and the mixture has an initial boiling point of about 188° C. and a dry point of about 206° C.

9. The fuel composition of claim 1, wherein the aromatic composition is present in the range of about 0. 5% to about 99.5 % by weight.

10. The fuel composition of claim 1, wherein the branched hydrocarbon is present in the range of about 0.5 % to about 99.5 % by weight.

11. The fuel composition of claim 1, wherein the aromatic composition is present in the range of about 10% to about 50% by weight, and the branched hydrocarbon is present in the range of about 50% to about 90% by weight.

12. A fuel composition, comprising:

a mixture of branched hydrocarbon and an aromatic composition, the aromatic composition having a boiling range from about 170° C. (354° F.) to about 213° C. (415° F.), wherein the fuel composition is substantially free of any naphthenic compounds and is capable of powering an internal combustion engine, and the fuel composition has a flash point of at least about 130° F.

13. The fuel composition of claim 12, wherein the fuel composition has a flash point of at least about 140° F.

14. The fuel composition of claim 12, wherein the branched hydrocarbon is isoparaffin.

15. The fuel composition of claim 12, wherein the aromatic composition includes one or more alkylated benzene compounds.

16. The fuel composition of claim 12, wherein the aromatic composition is a mixture comprising about 23 wt. % tetra-methyl benzenes, about 22 wt. % ethyl dimethyl benzenes, about 15 wt. % mono-, di- and tri-methyl indanes, about 8 wt. % diethyl benzenes, about 8 wt. % naphthalene, about 5 wt. % trimethyl benzenes, about 2 wt. % indane, and about 1 wt. % or less of methyl ethyl benzenes, propyl benzenes, methyl propyl benzenes, butyl benzenes, hexyl benzenes, indene, methyl naphthalenes, and xylenes.

17. The fuel composition of claim 14, wherein the isoparaffin is a mixture of $C_9$–$C_{12}$ isoparaffinic hydrocarbons with an average molecular weight of about 149, and the mixture has an initial boiling point of about 157° C. and a dry point of about 176° C.

18. The fuel composition of claim 14, wherein the isoparaffin is a mixture of $C_9$–$C_{12}$ isoparaffinic hydrocarbons with an average molecular weight of about 160, and the mixture has an initial boiling point of about 176° C. and a dry point of about 191° C.

19. The fuel composition of claim 14, wherein the isoparaffin is a mixture of $C_9$–$C_{12}$ isoparaffinic hydrocarbons with an average molecular weight of about 164, and the mixture has an initial boiling point of about 177° C. and a dry point of about 197° C.

20. The fuel composition of claim 14, wherein the isoparaffin is a mixture of $C_{10}$–$C_{13}$ isoparaffinic hydrocarbons with an average molecular weight of about 171, and the mixture has an initial boiling point of about 188° C. and a dry point of about 206° C.

21. The fuel composition of claim 12, wherein the aromatic composition is present in the range of about 0.5% to about 99.5% by weight.

22. The fuel composition of claim 12, wherein the branched hydrocarbon is present in the range of about 0.5% to about 99.5% by weight.

23. The fuel composition of claim 12, wherein the aromatic composition is present in the range of about 10% to about 50% by weight, and the branched hydrocarbon is present in the range of about 50% to about 90% by weight.

24. An emergency fuel for use in an internal combustion engine when a vehicle runs out of fuel, comprising:

a mixture ofa branched hydrocarbon and an aromatic composition, the aromatic composition having a boiling range from about 170° C. (354° F.) to about 213° C. (415° F.), wherein the emergency fuel is substantially free of any naphthenic compounds and is capable of powering an internal combustion engine, and the emergency fuel has a flash point of 120° F. or higher.

25. The emergency fuel of claim 24, wherein the emergency fuel has a flash point of at least about 140° F.

26. The emergency fuel of claim 24, wherein the branched hydrocarbon is isoparaffin.

27. The emergency fuel of claim 24, wherein the aromatic composition includes one or more alkylated benzene compounds.

28. The emergency fuel of claim 24, wherein the aromatic composition is a mixture comprising about 23 wt. % tetramethyl benzenes, about 22 wt. % ethyl dimethyl benzenes, about 15 wt. % mono-, di- and tri-methyl indanes, about 8 wt. % diethyl benzenes, about 8 wt. % naphthalene, about 5 wt. % trimethyl benzenes, about 2 wt. % indane, and about 1 wt. % or less of methyl ethyl benzenes, propyl benzenes, methyl propyl benzenes, butyl benzenes, hexyl benzenes, indene, methyl naphthalenes, and xylenes.

29. The emergency fuel of claim 26, wherein the isoparaffin is a mixture of $C_9$–$C_{12}$ isoparaffinic hydrocarbons with an average molecular weight of about 149, and the mixture has an initial boiling point of about 157° C. and a dry point of about 176° C.

30. The emergency fuel of claim 26, wherein the isoparaffin is a mixture of $C_9$–$C_{12}$ isoparaffinic hydrocarbons with an average molecular weight of about 160, and the mixture has an initial boiling point of about 176° C. and a dry point of about 191° C.

31. The emergency fuel of claim 26, wherein the isoparaffin is a mixture of $C_9$–$C_{12}$ isoparaffinic hydrocarbons with an average molecular weight of about 164, and the mixture has an initial boiling point of about 177° C. and a dry point of about 197° C.

32. The emergency fuel of claim 26, wherein the isoparaffin is a mixture of $C_{10}$–$C_{13}$ isoparaffinic hydrocarbons with an average molecular weight of about 171, and the mixture has an initial boiling point of about 188° C. and a dry point of about 206° C.

33. The emergency fuel of claim 24, wherein the aromatic composition is present in the range of about 0.5% to about 99.5% by weight.

34. The emergency fuel of claim 24, wherein the branched hydrocarbon is present in the range of about 0.5% to about 99.5% by weight.

35. The emergency fuel of claim 24, wherein the aromatic composition is present in the range of about 10% to about 50% by weight, and the branched hydrocarbon is present in the range of about 50% to about 90% by weight.

36. The emergency fuel of claim 24, wherein the emergency fuel has a flash point of 130° F. or higher.

* * * * *

UNITED STATES PATENT AND TRADEMARK OFFICE

CERTIFICATE OF CORRECTION

PATENT NO. : 6,353,143 B1
DATED : March 5, 2002
INVENTOR(S) : Fang et al.

It is certified that error appears in the above-identified patent and that said Letters Patent is hereby corrected as shown below:

Title page,
Item [74], the *Attorney, Agent, or Firm* should reflect -- Jenkens & Gilchrist A Professional Corporation --.

Column 1,
Line 19, after "Preferably," please insert -- the --.
Line 23, after "prior art for" please insert -- the --.

Column 2,
Line 12, please delete "gasolinle" and insert -- gasoline --.

Column 3,
Line 6, please delete the second "C" and insert -- D --.

Column 4,
Line 7, please delete "be".
Line 53, please delete "1" and insert -- 10 --.

Column 5,
Line 36, after "as" insert -- an --.
Line 36, after "octane" insert -- booster --.

Column 6,
Line 9, delete "IIA" and insert -- IAA --.

Column 10,
Line 48, please insert a space between "of" and "a".

UNITED STATES PATENT AND TRADEMARK OFFICE

CERTIFICATE OF CORRECTION

PATENT NO. : 6,353,143 B1 
DATED : March 5, 2002
INVENTOR(S) : Fang et al.

It is certified that error appears in the above-identified patent and that said Letters Patent is hereby corrected as shown below:

Column 12,
Line 30, please insert a space between "of" and "a".

Signed and Sealed this

Twenty-fourth Day of September, 2002

*Attest:*

*Attesting Officer*

JAMES E. ROGAN
*Director of the United States Patent and Trademark Office*